United States Patent [19]

Hagberg

[11] Patent Number: 4,701,586

[45] Date of Patent: Oct. 20, 1987

[54] MAGNETRON MOUNTING SYSTEM

[75] Inventor: Calvin A. Hagberg, Fridley, Minn.

[73] Assignee: Litton Systems, Inc., Beverly Hills, Calif.

[21] Appl. No.: 869,213

[22] Filed: May 30, 1986

[51] Int. Cl.[4] ..... H05B 6/00

[52] U.S. Cl. ..... 219/10.55 R; 219/10.55 M; 403/348; 403/376; 248/222.3

[58] Field of Search ..... 219/10.55 R, 10.55 F, 219/10.55 M; 315/39.51; 403/348, 349, 350, 376, 409; 24/590, 697, 662; 248/222.3, 223.2, 221.3

[56] References Cited

U.S. PATENT DOCUMENTS

| | | | |
|---|---|---|---|
| 1,874,313 | 6/1930 | Langley | 248/222.3 |
| 2,496,928 | 12/1947 | Bing | 403/348 |
| 3,066,367 | 11/1962 | Garman | 248/221.3 |
| 3,178,522 | 3/1962 | Passarelli | 200/295 |
| 3,858,996 | 1/1975 | Jarvis | 248/222.3 |
| 3,943,441 | 3/1976 | Shackford | 361/369 |
| 4,340,795 | 7/1982 | Arthur | 200/295 |

*Primary Examiner*—A. D. Pellinen
*Assistant Examiner*—Leon K. Fuller
*Attorney, Agent, or Firm*—John M. Haurykiewicz; Walter R. Thiel

[57] ABSTRACT

An improved system for mounting a magnetron exterior to a microwave oven chamber. A magnetron antenna extends through an orifice in the chamber wall and mounting clips extend from the chamber walls at locations spaced around the orifice. Apertures are provided within the keeper plate of the magnetron to allow the clips to pass therethrough and engage a keeper plate interface on relative rotation of the chamber wall and plate. The clips may be formed as part of the chamber wall.

18 Claims, 12 Drawing Figures

MAGNETRON MOUNTING SYSTEM

BACKGROUND OF THE INVENTION

1. Field of the Invention

The present invention relates generally to a magnetron mounting within a microwave oven.

2. Description of the Prior Art

Historically, magnetron mounting in such devices as microwave ovens has required four attachment studs or bolts with their cooperating nuts. In some cases the studs were on the magnetron while in other cases they were on an oven wall or on brackets. Such variation requires the stocking of several different configurations to meet all design and repair requirements. In addition, labor requirements are high due to the time consuming task of individually joining and tightening each fastener combination. During both manufacture and repair, space constraints complicate the mounting of the magnetron.

Space constraints are imposed by the common desire to make the unit as compact as possible. Efficiency and safety require that any oven chamber, such as the cooking cavity and waveguide, if any, be "sealed" and have as few discontinuities as possible. For this reason, mounting of a magnetron within a microwave oven has often employed a bracket which extends beyond the chamber in question and to, or into, an adjacent closely packed compartment.

SUMMARY OF THE INVENTION

The present invention provides a magnetron mounting system having particular application to microwave ovens. Magnetrons for this application typically have a protruding antenna positioned within a waveguide, with the waveguide connected to the cooking cavity which is adapted to hold an object to be heated. Alternatively, the magnetron antenna may be positioned within the oven cavity itself. In either case, the magnetron antenna extends through an orifice in the chamber wall. In a preferred embodiment of the present invention, mounting clips extend from the chamber walls at locations spaced around the orifice. In one embodiment, apertures are provided within the "keeper" plate of the magnetron with each aperture being positioned and configured to allow a different one of the clips to pass therethrough and engage the keeper plate interface on relative rotation of the chamber wall and plate. The clips may be formed from the chamber wall to include a first leg extending from the wall with a second leg being generally parallel to the chamber wall. On relative rotation of the wall and plate, the plate will overlie substantially all of any hole formed in the chamber wall during the formation of the clips from that wall. Dimples may be provided in the keeper plate to cooperate with the clips and provide a locking function.

In another embodiment, tabs on the magnetron "keeper" plate engage stamped depressions in the chamber wall upon relative rotation of the wall and plate. Dimples may again be provided in the depressions to provide a locking function.

In still another embodiment mounting clips are formed of and extend from the chamber wall to engage opposing edges of the magnetron keeper plate. Coined stops in the tabs retain the keeper plate without relative rotation of the wall and plate.

DETAILED DESCRIPTION

Figure 1:
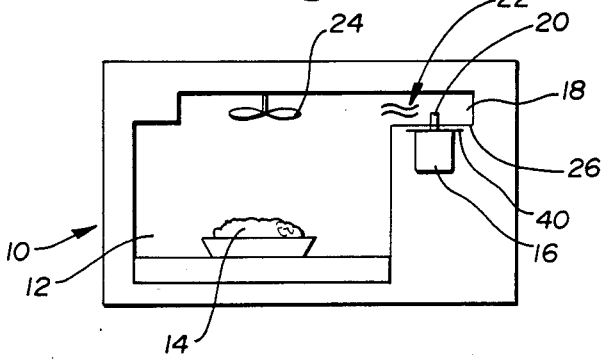
FIG. 1 is a generalized representation of a heating device employing a magnetron.

FIG. 1 is a generalized representation of a heating device, such as a microwave oven 10. The oven 10 consists of an oven cavity 12 into which an object 14 to be heated is placed. A magnetron 16 is mounted with its antenna 20 positioned within a chamber 18. Chamber 18 may be a waveguide or directly a part of cavity 12. Microwave radiation, generally referenced at 22, is directed from the antenna 20 into the cavity 12. A stirrer 24 is supplied to distribute the microwave energy 22 throughout the cavity 12. For the purposes of this specification and claims, the term "chamber" shall mean any portion of a microwave heating device in which microwave energy is contained or conducted.

Figure 2:
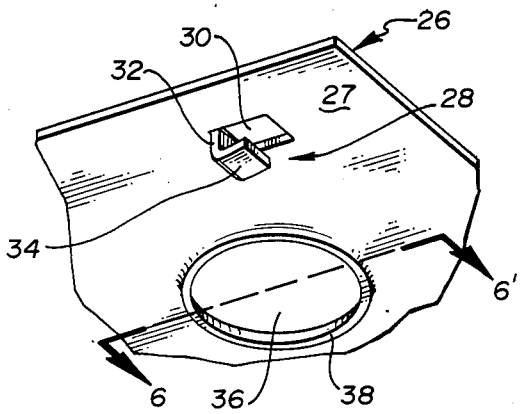
FIG. 2 is a partial perspective view of a oven chamber wall showing one embodiment of the mounting clip of the present invention.

FIG. 2 shows a partial perspective view of a wall 26 of a chamber such as the waveguide 18. In the embodiment shown, this is a lower wall of the waveguide 18. It is to be understood that the magnetron 16 can be mounted in many orientations and locations within the oven 10. A mounting clip 28 extends from the wall 26 and includes a spacer leg 32, which is preferably slightly inclined to wall 26, but may alternatively be generally perpendicular to the wall 26, and a support leg 34, which is generally parallel to the wall 26. The wall 26 also includes an orifice 36 with a lip 38 through which the antenna 20 of the magnetron 16 is inserted. As shown in FIG. 2, the clip 28 may be formed from the wall 26, as by stamping or punching, to result in an interruption or discontinuity 30 in the wall 26. The discontinuity 30 is discussed more fully below.

Figure 3:
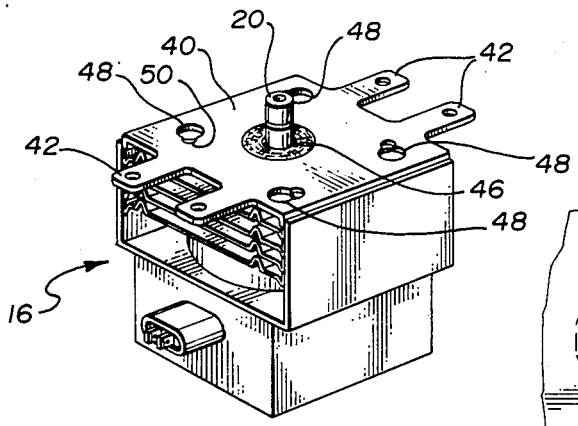
FIG. 3 is a perspective view of a magnetron showing a keeper plate in accordance with the present invention.

FIG. 3 is a perspective view of a typical magnetron 16 modified in accordance with the present invention. The magnetron 16 is provided with a keeper plate 40 which has been employed to secure the magnetron 16 to the wall 26. In the prior art, this was accomplished through the use of tabs 42 which were provided with holes 44 through which a mounting bolt (not shown) could be inserted to mount the magnetron in position relative to the waveguide 18.

Typically, the tabs 42 are configured to extend beyond the waveguide 18 to avoid discontinuities in the waveguide 18 resulting from the attachment systems. Often, the tabs 42 extended to, or into, an adjoining compartment. As noted, an antenna 20 extends from the magnetron 16, and is generally perpendicular to the keeper plate 40.

The antenna 20 is surrounded by a conductive member wire mesh washer 46 which is compressible and which is engaged by the lip 38 of the orifice 36 in order to provide an adequate seal and prevent the escape of microwave radiation. In general terms, the antenna 20 extends through a hole in the keeper plate 40 with that hole being larger than the aperture in the chamber wall. The washer 46 extends from the antenna to at least the bounds of the hole in the keeper plate 40, and may interlie that plate.

According to one embodiment of the present invention, the keeper plate 40 is provided with a plurality of apertures 48, the apertures 48 being positioned and configured to accept a different one of the mounting clips 28 while allowing it to pass therethrough. Dimples 50 may be provided adjacent to the holes 48 to provide a locking function. The dimples 50 are punched or coined so that they are slightly elevated from the inner face 41 of the keeper plate 40 as may be seen most clearly in FIG. 5. The length of the legs 32, the thickness of the keeper plate 40 and the "height" of the dimples 50 are interdependent. Essentially, the dimples may be designed to provide a frictional engagement between the leg 34 and the inner face 27 of the plate 26 for a given thickness of the wall 26 and a desired length of leg 32. Alternatively, dimples 50 may be designed to provide an "over-center" retaining action in cooperation with legs 34.

Figure 4:
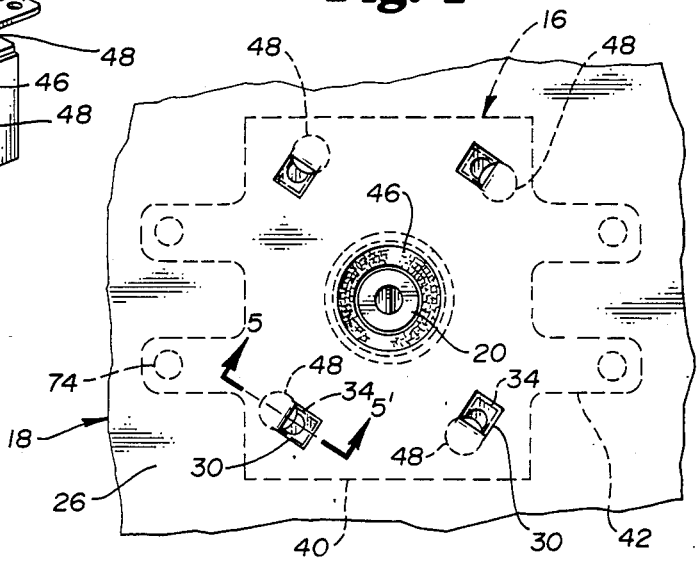
FIG. 4 is a view from the inside of a microwave chamber showing a magnetron mounted in accordance with the present invention.

FIG. 4 is an "inner" view of the wall 26 of the waveguide 18 with the magnetron 16 mounted in accordance with the present invention. The antenna 20 of the magnetron 16 is shown projecting through the orifice 36 in the waveguide wall 26 toward the viewer. The magnetron 16 is inserted in the microwave oven 10 by first aligning the apertures 48 in the keeper plate 40 with the mounting clips 28 in the waveguide wall 26. The antenna 20 is inserted through the orifice 36 in the waveguide wall 26. This will bring the legs 34 of clips 28 toward the apertures 48. Further movement will cause the lip 38 to compress the washer 46 while the legs 34 clear the inner face 41 of the plate 40 and dimples 50. The magnetron is then rotated relative to the wall 26 to cause the legs 34 to engage the inner face 41 of plate 40 (and any dimples 50) to mount and secure the magnetron 16 to the wall 26.

Figure 5:
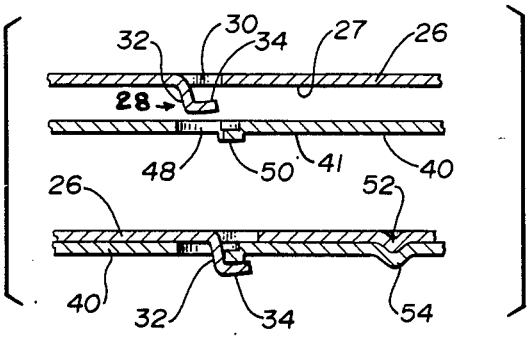
FIG. 5 shows both an exploded and an assembly view in cross-section along line 5—5' of FIG. 4.
Figure 6:
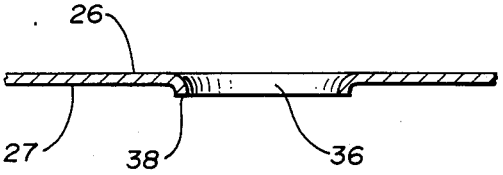
FIG. 6 is a cross-section through line 6—6' of FIG. 2.

As more clearly seen in FIG. 5, each mounting clip 28 extends through an aperture 48 in the keeper plate 40. When the magnetron 16 is rotated into mounted position, the support arm 34 of the mounting clip 28 engages and holds the inner face 41 of the keeper plate 40. The spacer arm 32 may be slightly shorter than the thickness of the keeper plate 40 (and any dimple 50) in order to provide a secure mounting and a tight seal. In this case, the fact that the washer or disc 46 is compressible facilitates mounting of the magnetron. Compression of the disc also provides a secure microwave radiation seal between the magnetron and chamber, in known manner. When the magnetron 16 and the keeper plate 40 are rotated into the mounting position, the discontinuities 30 in the waveguide wall 26 are sealed against the leakage of microwave radiation by the keeper plate 40 which overlies and covers substantially all, if not all, of that portion of the wall 26 from which the clips 32 are formed. Interlocking dimples 52, 54 may be provided on wall 26 and plate 40 remote from clips 28 and apertures 48, if desired, to retain magnetron 16 positively to waveguide 18.

Figure 7:
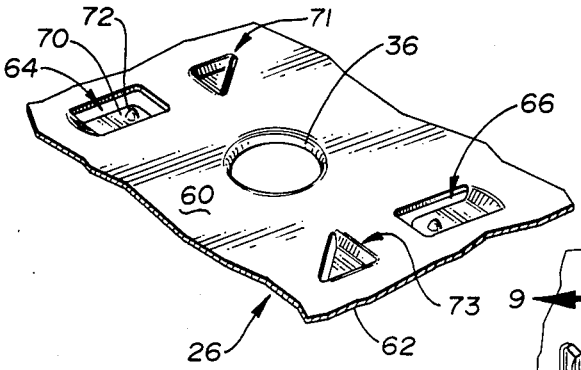
FIG. 7 is a partial perspective view of an oven chamber wall showing another embodiment of the present invention.
Figure 8:
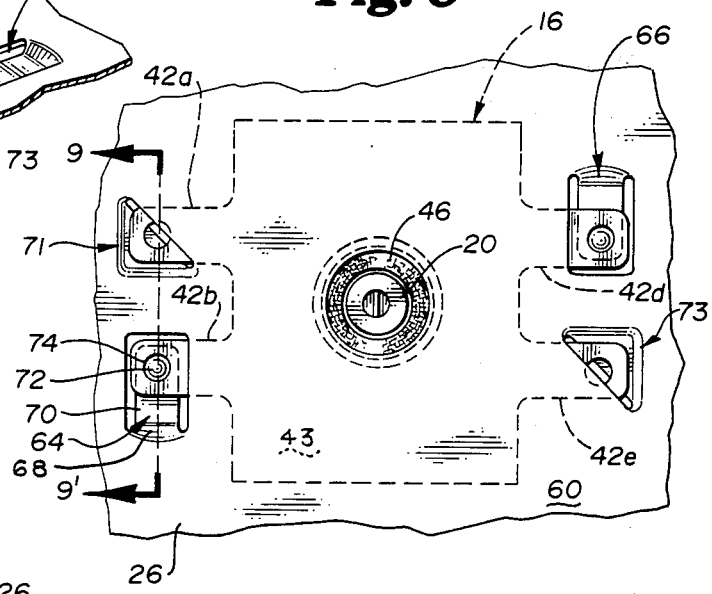
FIG. 8 is a view from inside the microwave chamber showing a magnetron mounted in accordance with the present invention.
Figure 9:
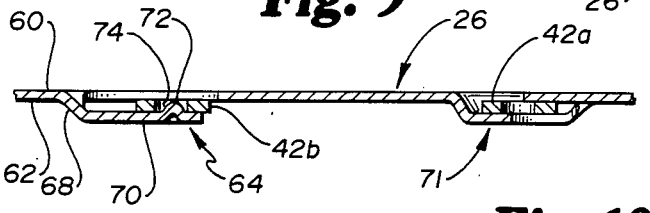
FIG. 9 is a cross-section view through 9—9' of FIG. 8.

Referring now more particularly to FIGS. 7, 8 and 9, a further embodiment of the present invention may be seen. FIG. 7 shows a perspective view of wall 26 having an upper surface 60 and a lower surface 62. FIG. 8 is a plan view as seen from the side of upper surface 60 which corresponds to the interior of waveguide 18. In this embodiment orifice 36 is the same as that of the previous embodiment. Preferably diagonally opposite tabs **42*b,d* are retained by clips 64, 66 which have a first leg 68 extending from wall 26 and a second leg 70 generally parallel to wall 26. Diagonally opposite tabs 42*a,c* are received and retained by pierced depressions 71, 73 which closely couple the outer face 43 of mounting plate 40 to the exterior or lower surface 62 of wall 26. A dimple 72 may be formed in second leg 70 for alignment with aperture 74 in tab 42. Alignment of dimple 72 with aperture 74 provides a locking function to resist release of magnetron 16 from its mounting in wall 26. Magnetron 16 is installed in this embodiment of the mounting system in a manner similar to that of the previous embodiment by positioning magnetron 16 at a relative angle of 15 to 30° to the mounting system and then rotating the magnetron into the position shown in FIG. 8**.

Figure 10:
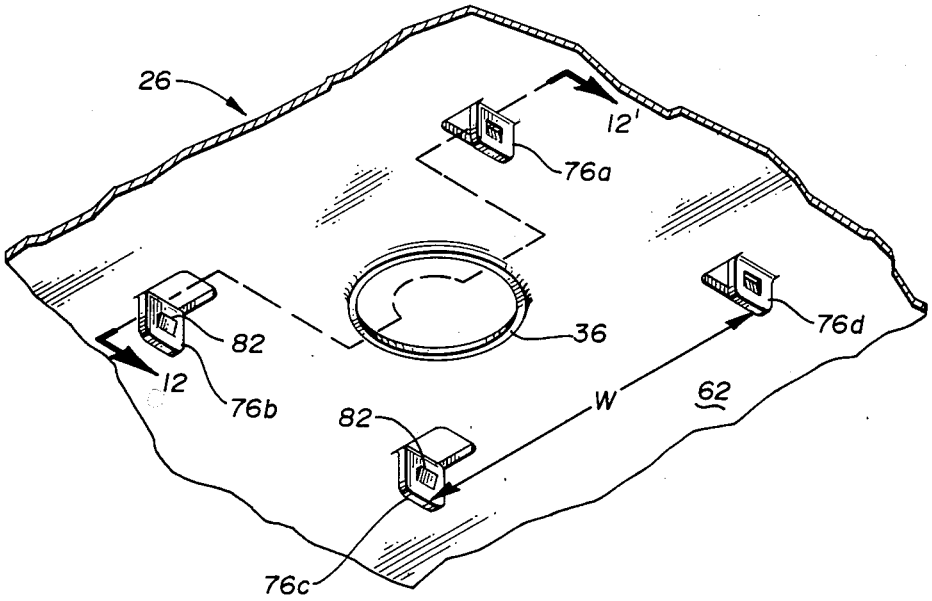
FIG. 10 is a partial perspective view of an oven chamber wall showing still another embodiment of the mounting clip of the present invention.
Figure 11:
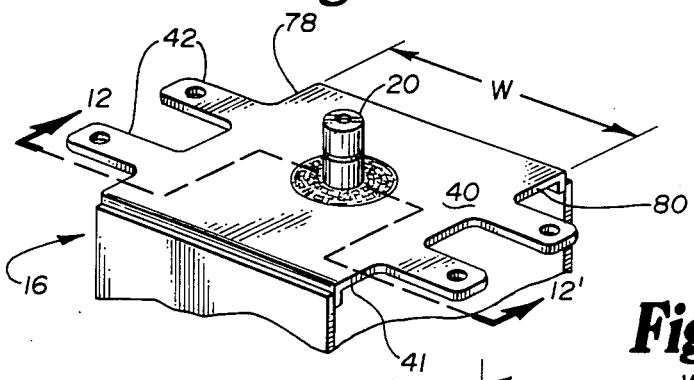
FIG. 11 is a partial perspective view of a magnetron oriented to be mounted to the mounting clips of FIG. 10.
Figure 12:
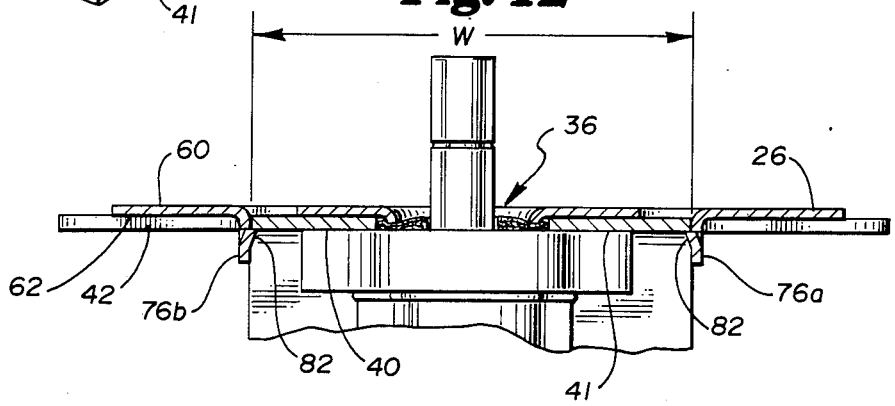
FIG. 12 is a cross-section view along lines 12—12' showing a completed assembly of FIGS. 10 and 11.

A still further embodiment of the magnetron mounting system is shown in FIGS. 10, 11 and 12.

In this embodiment a plurality of clips **76*a–d* extend perpendicular to the exterior or lower surface 62 of wall 26. Clip 76*a* is spaced a distance W from clip 76*b*. Similarly, clip 76*b* is spaced a distance W from clip 76*c*. Distance W is equal to the distance between opposite edges 78, 80 of the magnetron mounting plate 40. Orifice 36 is as in the previous embodiments. Each of the clips 76 has a projection or barb 82 designed to engage and retain the inner face 41 of plate 40 at edges 78 and 80**.

To install the magnetron 16 in the mounting system of this embodiment, the antenna 20 is inserted into aperture 36 and edges 78, 80 are aligned between clips 76 and keeper plate 40 is moved towards surface 62 until barbs 82 engage the inner face 41 of plate 40.

Although four mounting clips 76 are shown, it is to be understood as within the scope of this invention, that a greater or fewer number of clips may be utilized, for example a pair of mounting clips may be situated with one mounting clip 76 situated to retain plate 40 between tabs 42 on edge 78 and the other clip similarly situated to retain plate 40 between tabs 42 on edge 80.

As shown in FIG. 10, clips 76 may be formed from wall 26, and upon installation, plate 40 will overlie substantially all of the portion of the chamber wall 26 from which the associated clip is formed when magnetron 16 is installed.

Obviously, many modifications and variations of the present invention are possible in light of the above teachings. For example, a positive locking device may be employed to assure that the magnetron and wall will not rotate, relative to each other, and release. Such a locking device may be located on the magnetron 16 or the waveguide 18, or both. Further, it is contemplated that a rotation of 15° to 30° is desirable to assure a positive magnetron mounting. However, other relative rotation amounts may be employed within the scope of the present invention. It is therefore to be understood that the present invention may be practiced otherwise than specifically described.

What is claimed is:

1. In a microwave oven of the type wherein a magnetron having an extending antenna is mounted exterior to an oven chamber with said antenna extending through an orifice in a planar wall of said chamber and into said chamber, the megnetron including a generally planar mounting plate having an outer face, an inner face and a hole through which said antenna extends, an improved magnetron mounting system which comprises:

(a) a plurality of clip means each including:

(i) a first leg means extending from said chamber wall at locations spaced around said orifice, and (ii) a second leg means generally parallel with said chamber wall;

(b) a plurality of aperture means within said magnetron mounting plate, each aperture means being positioned and configured to allow a different one of said second leg means to pass therethrough and engage said plate inner face on relative rotation of said chamber wall and said magnetron mounting plate; and (c) locking means for locking said second leg means in engagement with said plate inner face.

2. The magnetron mounting system of claim 1 wherein said oven chamber comprises an oven cavity.

3. The magnetron mounting system of claim 1 wherein said oven chamber comprises a waveguide.

4. The magnetron mounting system of claim 1 wherein said locking means comprises dimple means.

5. The magnetron mounting system of claim 1 wherein said orifice is generally circular and includes an outwardly extending lip, said magnetron mounting system further comprising a compressible conductive member surrounding said antenna and engageable by said lip when said second leg means is in engagement with said plate inner face.

6. The magnetron mounting system of claim 1 wherein said clip means are formed from said chamber wall, said plate means being configured adjacent each aperture means to overlie substantially all of that portion of said chamber wall from which the associated clip means is formed following said relative rotation.

7. The magnetron mounting system of claim 6 wherein said orifice is generally circular includes an outwardly extending lip, said magnetron mounting system further comprising a compressible conductive member surrounding said antenna and engageable by said lip when second leg means is in engagement with said plate inner face.

8. In a microwave oven of the type wherein a magnetron having an extending antenna is mounted exterior to an oven chamber with said antenna extending through an orifice in a planar wall of said chamber and into said chamber, the magnetron including a generally planar mounting plate having mounting tabs extending from the magnetron in the plane of the plate, with the plate further having an outer face, an inner face and a hole through which said antenna extends, an improved magnetron mounting system which comprises:

(a) a plurality of clip means each including:

(i) a first leg means extending from said chamber wall at locations spaced around said orifice, and (ii) a second leg means generally parallel with said chamber wall;

(b) a plurality of pierced depression means within said wall, each pierced depression means being positioned and configured to receive and retain a different one of said mounting tabs therein to closely couple the outer face of said mounting plate to the exterior of said chamber wall upon relative rotation of said chamber wall and plate; and (c) locking means for locking said second leg means in engagement with said plate inner face.

9. The magnetron mounting system of claim 8 wherein said oven chamber comprises an oven cavity.

10. The magnetron mounting system of claim 8 wherein said oven chamber comprises a waveguide.

11. The magnetron mounting system of claim 8 wherein at least one of said mounting tabs contains an aperture therethrough and at least one of said clip means is positioned to receive and retain said one mounting tab and wherein said one clip means contains dimple means positioned to align and project into the aperture in said one mounting tab.

12. The magnetron mounting system of claim 8 wherein said clip means are formed from said chamber wall, said plate means being configured in the region of said mounting tabs to overlie substantially all of that portion of said chamber wall from which the associated clip means is formed following said relative rotation.

13. The magnetron mounting system of claim 8 wherein said locking means comprises dimple means.

14. In a microwave oven of the type wherein a magnetron having an extending antenna is mounted exterior to an oven chamber with said antenna extending through an orifice in a planar wall of said chamber and into said chamber, the magnetron including a generally planar mounting plate having an outer face, an inner face and a hole through which said antenna extends, an improved magnetron mounting system which comprises:

a plurality of clip means each including a leg means extending substantially perpendicularly from said chamber wall and spaced apart a distance equal to the distance between opposite edges of said magnetron mounting plate and having barb means projecting into the space between said leg means such that said leg means abut opposite edges of said mounting plate and said barb means engage and retain the inner face of said plate to closely couple the outer face of said plate with the exterior of said chamber wall.

15. The magnetron mounting system of claim 14 wherein said oven chamber comprises an oven cavity.

16. The magnetron mounting system of claim 14 wherein said oven chamber comprises a waveguide.

17. The magnetron mounting system of claim 14 wherein said orifice is generally circular and includes an outwardly extending lip, said magnetron further comprising a compressible conductive member surrounding said antenna and engageable by said lip when said barb means is in engagement with said plate inner face.

18. The magnetron mounting system of claim 14 wherein said clip means are formed from said chamber wall, said plate means being configured adjacent each aperture means to overlie substantially all of that portion of said chamber wall from which the associated clip means is formed upon engagement of said barb means with said plate inner face.

* * * * *